US006681945B1

(12) United States Patent
Harrold

(10) Patent No.: US 6,681,945 B1
(45) Date of Patent: Jan. 27, 2004

(54) CHILD RESISTANT OVERCAP FOR OVAL CONTAINER

(75) Inventor: John E. Harrold, Bloomsbury, NJ (US)

(73) Assignee: Valley Design, Inc., Bloomsbury, NJ (US)

( * ) Notice: Subject to any disclaimer, the term of this patent is extended or adjusted under 35 U.S.C. 154(b) by 0 days.

(21) Appl. No.: 10/358,611

(22) Filed: Feb. 5, 2003

(51) Int. Cl.[7] ..... A61J 1/00
(52) U.S. Cl. ..... 215/204; 215/222
(58) Field of Search ..... 215/204, 216, 215/217–221, 222, 277, 332, 11.6; 220/281, DIG. 13

(56) References Cited

U.S. PATENT DOCUMENTS

| | | | | |
|---|---|---|---|---|
| 3,716,161 A | | 2/1973 | Julian et al. | |
| 4,049,148 A | | 9/1977 | Suhr et al. | |
| 4,273,248 A | * | 6/1981 | Lehmann | 215/331 |
| 4,346,809 A | | 8/1982 | Kusz | |
| 4,387,817 A | | 6/1983 | Wiles et al. | |
| 4,535,906 A | * | 8/1985 | Rowekamp | 215/329 |
| 4,948,002 A | * | 8/1990 | Thornock et al. | 215/221 |
| 5,148,931 A | | 9/1992 | Minh | |
| 5,161,706 A | | 11/1992 | Weinstein | |
| 5,217,130 A | | 6/1993 | Weinstein | |
| 5,228,583 A | | 7/1993 | Weinstein | |
| 5,687,863 A | * | 11/1997 | Kusz | 215/216 |
| 5,927,531 A | * | 7/1999 | Kuzma et al. | 215/321 |
| 6,367,640 B1 | | 4/2002 | Julian | |

* cited by examiner

*Primary Examiner*—Jacob K. Ackun
*Assistant Examiner*—Jamila Williams
(74) *Attorney, Agent, or Firm*—Kenneth P. Glynn, Esq.

(57) ABSTRACT

A child resistant overcap and container device is specifically for containers having non-round bodies, at least non-round upper bodies, with round necks, especially oval shaped containers. The container has a round neck for attachment of an inner cap. The shape of the container is such that it is wider than it is deep, to create side to side shoulders. There is also a collar permanently attached to the neck that has an open, central circular portion and a pair of opposite shoulders extending outwardly from side to side above the shoulders of the container. The collar has either at least one J-slot or at least one J-slot tracking protrusion located on at least one of its front and back. There is also an overcap having a front and back and opposing sides, and having a hollow inside. The overcap has an outside footprint substantially corresponding to the footprint of the container. The overcap, relative to the collar, has the other of at least one J-slot and at least one J-slot tracking protrusion located in at least one of the front and the back, corresponding to the collar.

20 Claims, 5 Drawing Sheets

CHILD RESISTANT OVERCAP FOR OVAL CONTAINER

BACKGROUND OF THE INVENTION

1. Field of the Invention

The present invention relates to child resistant caps for containers, and, more specifically, to non-round containers, especially oval containers. Thus, the present invention pertains to child resistant overcaps for odd shaped containers, especially oval containers.

1. Information Disclosure Statement

The following patents represent child resistant safety caps and containers:

U.S. Pat. No. 3,716,161 describes a safety closure for a medicine bottle or like. The closure and bottle neck have cooperating lug and ramp means of the bayonet type. The closure is placed over the bottle neck, depressed onto the neck and rotated relative to the neck to engage the lugs and ramps. To remove the closure, it is pressed downwardly to disengage the lugs and then rotated in the opposite direction. The closure is biased upwardly relative to the bottle neck by the engagement of an annular conical shoulder on the closure with upwardly turned fingers on a disc-like biasing element that is positioned between the top of the closure and the end of the bottle neck.

U.S. Pat. No. 4,049,148 describes a child resistant safety closure and container assembly of the type including a cap having locking lugs projecting from its skirt for engagement with complementary bayonet locking elements on the container. A combined spring and sealing member is carried be the cap to resiliently maintain the cap and container in locked engagement, and provide a moisture proof seal. The spring and sealing member includes a plunger having a cylindrical base portion concentric with a cylindrical sealing wall. A plurality of radial stiffening members extend between the base portion and the inner end of the cylindrical sealing wall. In one embodiment, the stiffening members are in the form of ribs molded integrally to the side wall. In another embodiment, the stiffening members are in the form of flutes molded into the side wall.

U.S. Pat. No. 4,346,809 describes a convertible child-resistant close that comprises an outer closure and an inner resilient liner. When applied to a cooperating container in the child-resistant mode, the resilient liner is distorted between the container rim and abutments formed on the outer closure panel, thereby providing an upward locking bias to the closure. The upper surface of the liner includes depressions adapted to receive the abutments only when the liner and the outer closure are in particular relative angular orientation. To convert the assembly to a closure are in a particular relative angular orientation. To convert the assembly to a closure which is not child-resistant, the liner is removed and reoriented so that the abutments are received within the depressions, thereby preventing the abutments from distorting the liner to provide the locking bias.

U.S. Pat. No. 4,387,817 describes a child-resistant package characterized by a container with a thread neck portion, a closure provided with a multiplicity of threads cooperatively engaging the threads on the neck portion, means connected to the threaded neck portion for stopping the threading rotation of the closure onto the threaded neck portion at a predetermined position, and resilient liner means interposed between the underside of the top of the closure and the top of the neck portion.

U.S. Pat. No. 5,148,931 describes a new and simple tamper-resistant, safety closure for a container having threaded neck. It requires the user to align the two arrows, then give it and upward lift while turning in the counter-clockwise direction to unscrew it from the container. Features of the invention useful in accomplishing the above objects include an outer cap and an inner cap. The interior surface of the outer cap has a plurality of identical protrusions, called the type A protrusions, and one type B protrusion. The exterior surface of the inner cap has plurality of identical grooves, called the type A grooves, and one type B groove. If the type B protrusion is lifted into the type B groove, then the two caps inter-lock and turning the outer cap in the counter-clockwise direction would also turn the inner cap in the same direction, resulting in the unscrewing of the closure from the container. On the other hand, if the type B protrusion is lifted into one of the type A grooves, then the outer cap will rotate without unscrewing the inner cap from the container.

U.S. Pat. No. 5,161,706 describes a twist and push snap-on, child resistant cap and container that has an inner cap seal which is easily snapped onto a neck of a container and an outer cap. The outer cap has a top and sidewalls and has a greater cross-sectional area than the inner cap, and receives and physically restrains the inner cap within the outer cap such that the inner cap may be moved upwardly and downwardly within it over specified distance. The outer cap includes a locking lug located on its inside wall adapted to snap over a circumferential bead located in the neck of the container. There is a stop located on the inside wall of the outer cap and is freely rotatable about the neck of the container except when in contact with stop(s) on the neck of the container at its level of rotation when the outer cap is on the container. A spring mechanism located between the inner and outer cap so as to bias downwardly the inner cap. There is bead located circumferentially about its neck with a break to allow the lug and stop of the outer cap to pass therethrough. A first stop is located on the neck near but not above or below the opening in the bead and a second stop, larger than the first, is capable of preventing movement of the outer cap when rotated with its stop against its second stop.

U.S. Pat. No. 5,217,130 describes a child resistant closure for containers with threaded necks. It involves a cylindrical inner and outer cap which engage with one another by ratchets to close the closure. These ratchets do not engage when an attempt is made to open the closure. The inner cap has threads on its inside and is adapted to non-removably receive the outer cap in that the outer cap is rotatably engaged therewith. The outer cap is non-removably but rotatably mounted on and engaged with the inner cap. At least two biased keyway slots are used and each may be located either on the outside of the inner cap or the inside of the outer cap. There at least two biased keyway protrusions, one corresponding to each slot, and each protrusion extends toward its corresponding keyway slot. Each is located on which ever of the inner cap and outer cap does not contain the corresponding slot. There are indexes on each of the caps and when they are aligned, the keyway protrusions ad their corresponding keyway slots wills be aligned. The user will align the indexes or indicia and then lift up so that the protrusions fit into their keyway slots. In this manner, the outer cap engages the inner cap so that they are simultaneously rotated for opening. Upon closure, the protrusion will be pushed or dropped out of the slot and the ratchets will engage for proper closure.

U.S. Pat. No. 5,228,583 describes a child resistant closure for containers with threaded necks. It involves an inner cap and an outer cap which engages with one another by ratchets in order to close but these ratchets do not engage when an attempt is made to open the closure. The inner cap and outer cap are generally cylindrical and have sides and a top, although the outer cap may have an open top. The inner cap has threads on its inside and is adapted to non-removably receive the outer cap so that the outer cap is rotatably engage therewith. The outer cap is non-removably but rotatably mounted on an engaged with the inner cap. At least one keyway slot is located either on the outside of the Inner cap or the inside of the outer cap and there is at least one keyway protrusion extending toward the keyway slot and located in which ever of the inner cap and outer cap does not contain the slot. There are indexes on each of the caps and when they are aligned, the keyway protrusion and the keyway slot will be aligned. The user will align the indexes or indicia and then lift up so that the protrusion fits into the keyway slot. In this manner, the outer cap engages the inner cap so that they are simultaneously rotated for opening. Upon closure, the protrusion will be pushed or dropped out of the slot and the ratchets will engage for proper closure.

U.S. Pat. No. 6,367,640 describes a container having an open-ended and externally screw threaded cylindrical neck is fitted with a closure cap having an internal screw thread adapted to cooperate with the thread on the container neck and planar end wall adapted to form seal with the open end of the container neck. At least one of the opposing surfaces of the screw threads on the cap and the container neck is sufficiently inclined to the plane perpendicular to the axis of the neck of the container at the angle of at least 60° so that the screw threads can slip laterally on one another to enable the side wall of the cap or the neck of the container to deform when the cap is tightened onto the container to form a seal.

Notwithstanding the prior art, the present invention is neither taught nor rendered obvious thereby.

SUMMARY OF THE INVENTION

The present invention relates to a child resistant overcap and container device. It is specifically developed for containers having non-round bodies, at least non-round upper bodies, with round necks. These containers could be elongated or irregular hexagonal containers, rectangular containers, trapezoidal containers, etc., and they are preferably oval. These configurations apply to both inside and outside top view footprints.

Thus the container of the present invention device has a round neck for attachment of a cap, and has a hollow body, a portion of the hollow body being an upper body adjacent the round neck. The upper body has a non-circular footprint with a front and back and opposing sides. The upper body of the container has a predetermined width as measured from side to side, and has a predetermined depth as measured from front to back, wherein the predetermined to create side to side shoulders.

There is also a collar permanently attached to the round neck of the container. The collar has an open, central circular portion about the round neck, and the central circular portion has a front and back and opposing sides. The collar has a pair of opposite shoulders extending outwardly from side to side of the central circular portion and above the shoulders of said upper body of the container. The collar has either at least one J-slot and at least one J-slot tracking protrusion located on at least one of its front and back.

There is an inner cap, also referred to herein as a cap, that is removably attachable to the round neck of said container. This cap may be any known closure. There is also an overcap having a front and back and opposing sides, and having a hollow inside. The overcap has an outside footprint substantially corresponding to the footprint of the upper body of the container. The overcap, relative to the collar, has the other of at least one J-slot and at least one J-slot tracking protrusion located in at least one of the front and the back, corresponding to the collar. In other words, either the overcap or the collar may have a J-slot and the other will have the corresponding protrusion.

Thus, a user may create a child resistant closure by pushing the overcap downwardly on the collar with the overcap front in alignment so as to cause movement of at least one protrusion/J-slot for locking engagement thereof wherein the opposite shoulders of the collar push upwardly against the overcap to maintain J-slot and protrusion engagement, and wherein the overcap is removed by complex motion of pushing downwardly and rotating and then lifting upwardly.

The cap that operates to open or close access to the container and is attached to or attachable to the round neck may be any type of cap, but in some preferred embodiments, neck is a threaded neck and the cap is a screwcap.

Also, in some preferred embodiments the collar shoulders are springs adapted to push upwardly on the overcap when the overcap is attached to the collar. The present invention child resistant overcap may include spring contacts on its inside sides corresponding to and adapted to engage the collar springs when the overcap is attached to the collar.

In some preferred embodiments, the present invention child resistant overcap and container device includes a collar that has at least one J-slot and the overcap has at least one J-slot tracking protrusion. Preferably there is at least one J-slot is located on the collar front. In a most preferred embodiment the present invention child resistant overcap and container device includes a collar that has at least two J-slots and the overcap has at least two J-slot tracking protrusions.

In another embodiment, the collar has at least one J-slot tracking protrusion and the overcap has at least one J-slot, e.g. each have two.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
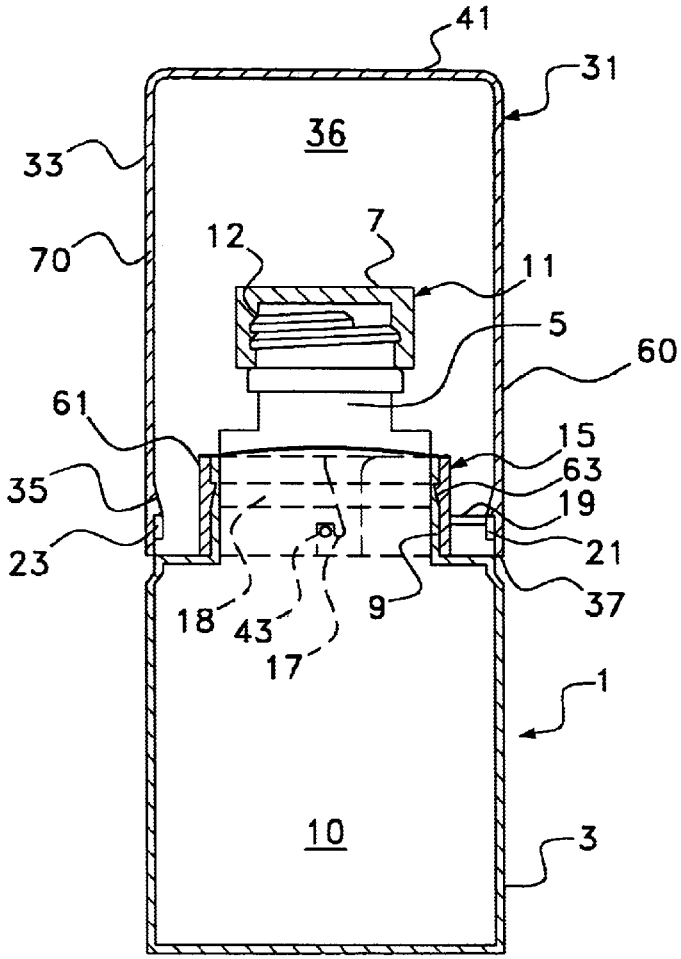
FIG. 1 illustrates a front, partially cut view of a present invention device showing a container, screw cap, collar, and overcap.

FIG. 1 shows a front view of a present invention device that is a cut view, except for a part of the container neck.

Thus, container I has a hollow inside 10 with a top view front print of an oval. It includes hollow body 3 and a round neck 5. In this case, neck 5 has a greater diameter neck area 9, as well as a circular recess and alignment slot (more specifically identified and discussed below). Neck 5 includes threads 7 that correspond to inside threads 12 of inner cap 11. Although inner cap 11 is threaded it could be any type of cap, including flip caps, snap caps, stoppers, push-pulls, metered dispensing caps, etc.

Collar 15 includes protrusions 61 and 63 that enable a manufacturer to slide collar 15 onto neck 5 to lock onto recess 18, as shown. Collar 15 two J-slots, one of which is cut from FIG. 1 and the other J-slot is J-slot 17 on the back outside of collar 15.

Figure 2:
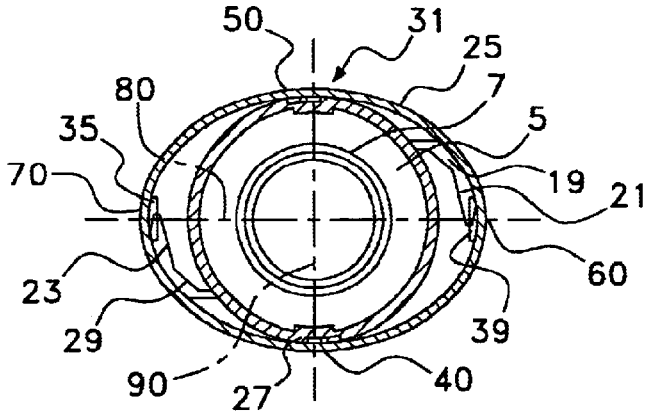
FIG. 2 shows a top cut view of the device shown in FIG. 1.

Referring now to both FIGS. 1 and 2, FIG. 2 showing top cut view of the FIG. 1 device with inner cap 11 removed, there is a side to side centered line 80 and a front to back center line 90. Overcap 31 has a top 41, a side wall 33 and a hollow inside 36. It has an alter perimeter top view footprint that is non-circular, that is, in this embodiment, an oval. Likewise, its top or bottom of its inside perimeter is also non-circular. A critical feature of the present invention is that child resistant overcaps that are non-circular on their insides and outsides may be produced and will function effectively with in the context of the present invention.

Figure 5:
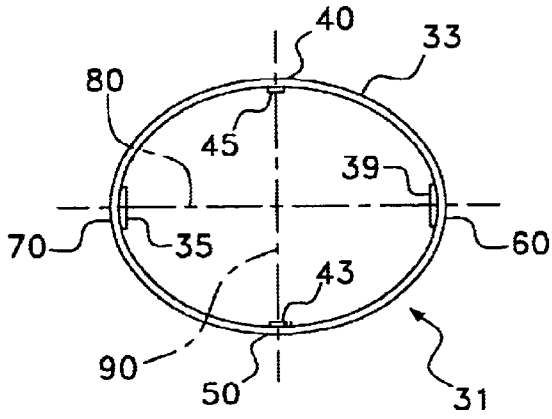
Figure 8:
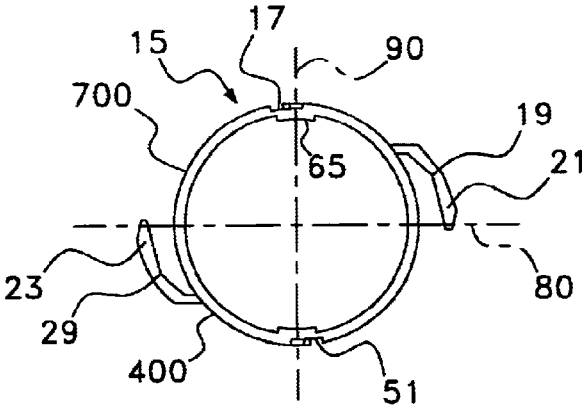

Overcap 31 has a front 40, a back 50, a right side 60. In FIGS. 2, 5, and 8, center lines 80 and 90 are shown as references of orientation, namely, front to back and center line 90 and side to side for center line 80. As can be seen if FIG. 2, overcap 31 has a predetermined width from side to side that is greater than the predetermined depth from front to back. This is true both as to outside footprint and inner most inner footprint as determined from the inside center (the intersection of centered lines 80 and 90, for example).

Collar 15 includes a central circular portion as shown in FIG. 2, as well as a pair of opposing shoulders 19 and 29 extending outwardly from the central circular portion. These rest above the wider part of container 1, that is, over its shoulders. Shoulders 19 and 29 are natural springs and include catches 21 and 23 that push upwardly on protrusions 35 and 39 of overcap 31 when overcap 31 is in alignment with container 3, that is fronts and sides and back are coincidental. This will occur when overcap 31 is pushed onto container 1 and J-slot tracking protrusions enter and lock into the J-slots of collar 15. This illustrated in FIG. 1 where protrusion 43 has been driven into the locking position of J-slot 17 and shoulders 19 and 29 with their catches 21 and 23 push upwardly against protrusions 35 and 39 of overcap 31.

Figure 3:
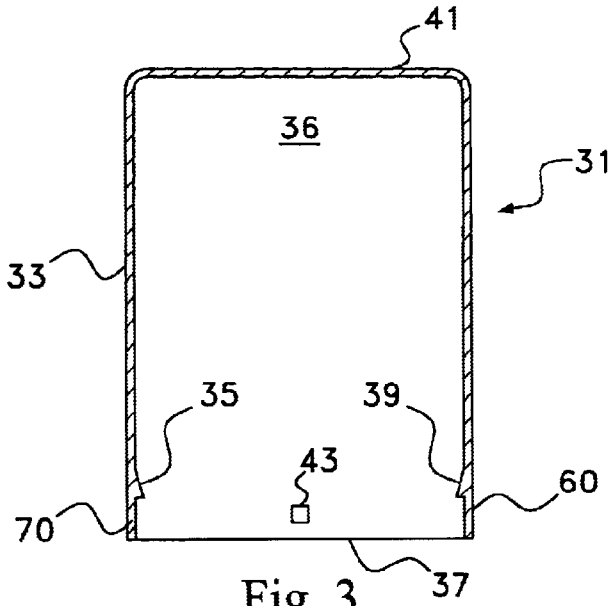
FIGS. 3, 4, and 5 show front cut, side cut and bottom views of the present invention overcap of the present invention device shown in FIG. 1.
Figure 4:
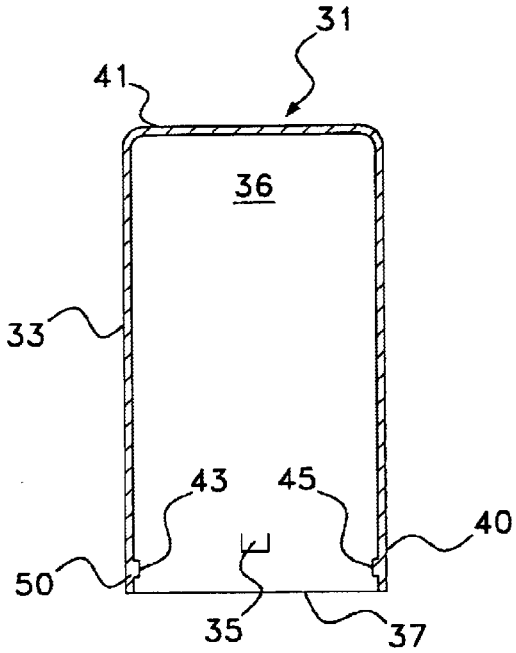

FIGS. 3, 4, and 5 show a front cut view, a side cut view and a bottom view of overcap 31 without any obstructing components and clearly establish the hollow oval inside and outside dimensions and an overall top view oval footprint. The individual elements show in these Figures are identical to those shown in FIGS. 1 and 2 with the exception that, both front and back protrusions 45 and 43 are shown in FIGS. 4 and 5. Otherwise identical parts are identically numbered and need not be repeated here.

FIGS. 6, 7, 8, and 9 illustrate a front view, a cut front view, a top view, and a side view, respectively, as shown in FIGS. 1 and 2. Identical parts are identically numbered.

Figure 6:
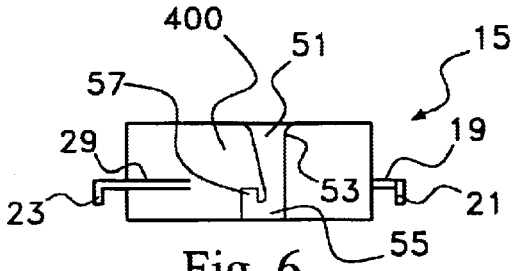
FIGS. 6, 7, 8, and 9, respectively, illustrate a front view, a front cut view, a top view and a side view of the collar of the present invention device of FIG. 1.
Figure 9:
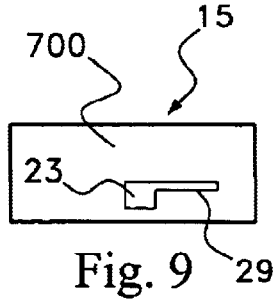

FIG. 6 shows J-slot 51 which has a bottom 55 that would contact the bottom of neck 7, and a short upward lock in area 57. This would receive and lock in protrusion 45 of overcap 31 discussed above. J-slot 51 has curved tops such as curve 53 to assist in guiding protrusion 45 during usage.

Figure 7:
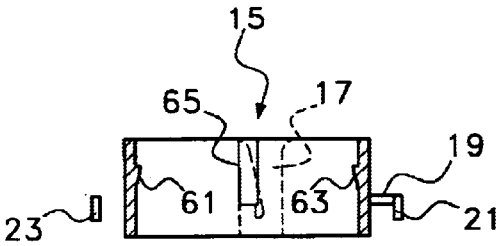

FIG. 7 shows a cut view and illustrates protrusion 61 and 63 as well as positioning guide 65. These act to properly align collar 15 on neck 5 and to secure collar 15 to neck 5 to prevent its removal.

Referring to FIGS. 6, 7, 8, and 9 collectively the shoulders 19 and 29 are positioned to float above the widest portions (shoulders or sides) of container 1 and are curved outwardly in a fashion to not interfere with the downward motion or rotational motion of overcap 31 when it is properly being attached. These figures also illustrate front 400 and side 700 for orientation relative to center lines 80 and 90. Also, these figures illustrate that the J-slots are located in the front and back of collar 15.

Figure 10:
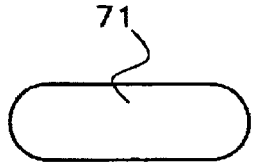
FIGS. 10, 11, 12 show footprints of some alternative shapes of present invention device overcaps.
Figure 11:
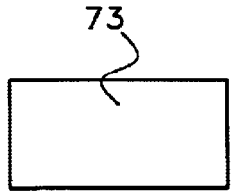
Figure 12:
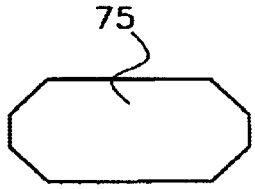

FIGS. 10, 11, and 12 show alternative shapes 71, and 73 and 75 as merely examples of other types of internal/external shapes of overcaps of the present invention devices.

Figure 13:
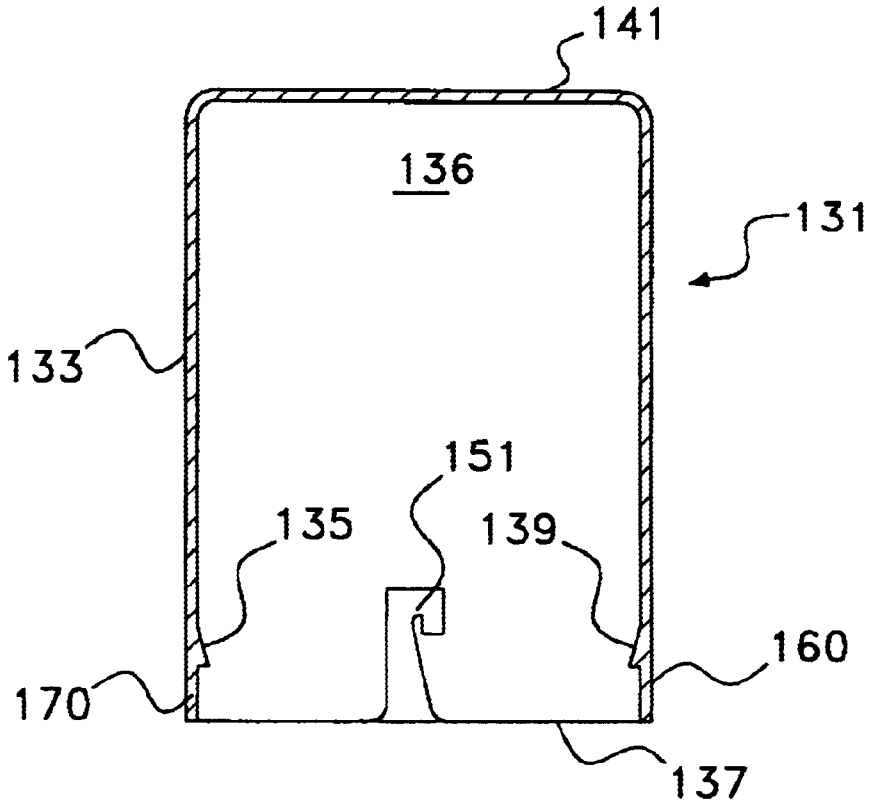
FIGS. 13 and 14, respectively, show a cut front view and a front view of an alternative invention overcap and collar; and, FIGS. 15 and 16 illustrate top and front views, respectively, of yet another present invention collar embodiment.
Figure 14:
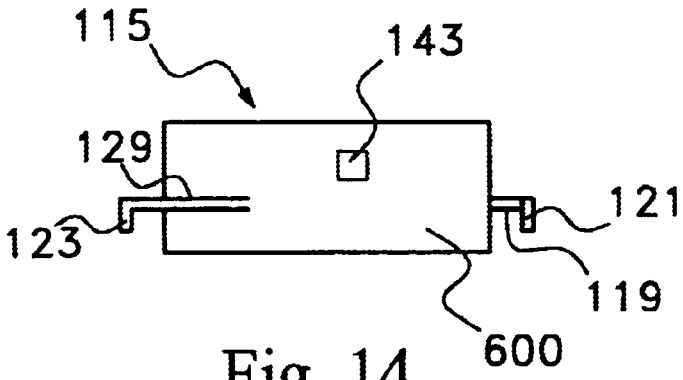

FIGS. 13 and 14, respectively show a cut front view of a alternative embodiment overcap 131 and a front view of a alternative embodiment collar 115.

Overcap 131 has a hollow inside 136, a bottom edge 137, sidewall 133 and a top 141. Left side 170 has a shoulder spring engagement protrusion 135 and a right side similar protrusion 139. These are adapted for tense engagement with shoulders 119 and 129 (FIG. 14) at their respective ends 121 and 123. In the FIGS. 13 and 14 embodiments, the overcap 131 had two J-slots, exemplified by inverted J-slot 151. Collar 115 has a pair of protrusions for J-slot tracking, such as protrusion 143 on front 600. Collar 115 and overcap 131 could, for example, replace collar 15 and overcap 31 and function effectively with container 1 of FIG. 1, above.

Figure 15:
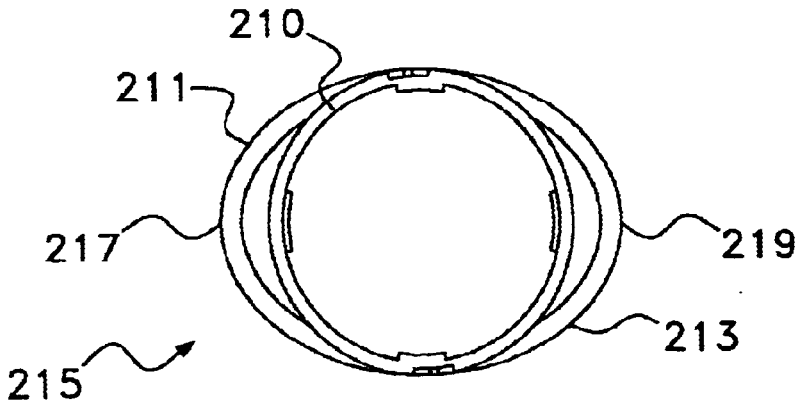
Figure 16:
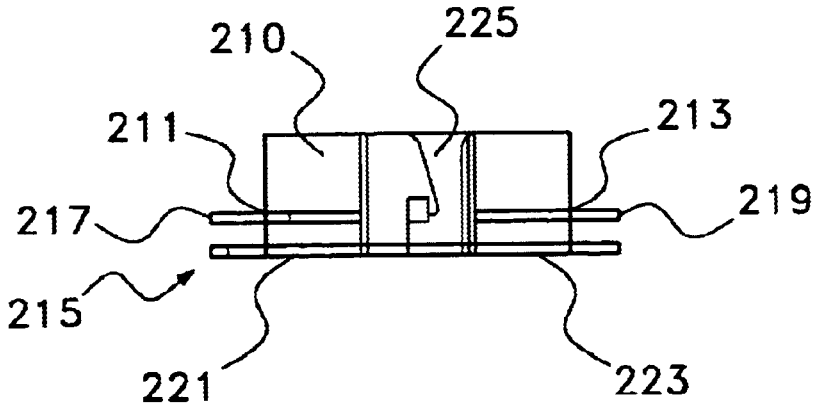

FIG. 15 shows a top view of another present invention collar 215, and FIG. 16 shows a front view thereof. Collar 215 includes a main circular hollow body 210. Shoulders 211 and 213 extend outwardly from the sides of body 210, as shown, and are arc-shaped instead of linear extensions with tension engagement ends (e.g. shoulders 119 and 129, FIG. 14 above), and have arcuated engagement tips 217 and 219, as shown. (This collar 215 could replace, for example, collar 115, above (FIG. 14) and function in a similar manner.) Collar 215 also has additional flanges 221 and 223, that aid in prevention of excessive downward movement from the desired collar location on the container (e.g. container 1 of FIG. 1, above). The other collar features described above are also included here on collar 215. Thus, J-slot 225 is shown and a second one 180° off (behind it) would also be included. Likewise orientation and container securing protrusions 227 and 229, shown in FIG. 15, for permanently securing collar 215 to a container.

Obviously, numerous modifications and variations of the present invention are possible in light of the above teachings. It is therefore understood that within the scope of the appended claims, the invention may be practiced otherwise than as specifically described herein.

What is claimed is:

1. A child resistant overcap and container device, which comprises:

a.) a container having a round neck for attachment of a cap, and having a hollow body, a portion of said hollow body being an upper body, adjacent said round neck, said upper body having a non-circular footprint with a front and a back and opposing sides, said upper body having a predetermined width as measured from side to side, and a predetermined depth as measured from front to back, wherein said predetermined width is greater than said predetermined depth;

b.) a collar permanently attached to said round neck, said collar having an open, central circular portion about said round neck, said central circular portion having front and back and opposing sides, said collar having a pair of opposite shoulders extending outwardly from said central circular portion and above said shoulders of said upper body of said container, said collar having one of at least one J-slot and at least one J-slot tracking protrusion located on at least one of its front and back;

c.) a cap removably attachable to said round neck of said container;

d.) an overcap having a front and a back and opposing sides, and having a hollow inside, and having an outside footprint substantially corresponding to said footprint of said upper body of said container, said overcap, relative to said collar, having the other of at least one J-slot and at least one J-slot tracking protrusion located in at least one of said front and said back; wherein a user may create a child resistant closure by pushing said overcap downwardly on said collar with said overcap front in alignment so is to cause movement of at least one J-slot for locking engagement thereof wherein said opposite shoulders of said collar push upwardly against said overcap to maintain J-slot and protrusion engagement, and wherein said overcap is removed by complex motion of pushing downwardly and rotating and then lifting upwardly.

2. The child resistant overcap and container device of claim 1 wherein said neck is a threaded neck and said cap is a screwcap.

3. The child resistant overcap and container device of claim 1 wherein said collar shoulder are springs adapted to push upwardly on said overcap when said overcap is attached to said collar.

4. The child resistant overcap and container device of claim 3 wherein said overcap includes spring contacts on its inside sides corresponding to and adapted to engage said collar springs when said overcap is attached to said collar.

5. The child resistant overcap and container device of claim 1 wherein said collar has at least one J-slot and said overcap has at least one J-slot tracking protrusion.

6. The child resistant overcap and container device of claim 5 wherein said at least one J-slot is located on said collar front.

7. The child resistant overcap and container device of claim 5 wherein said collar has at least two J-slots and said overcap has at least two J-slot tracking protrusions.

8. The child resistant overcap and container device of claim 1 wherein said collar has at least one J-slot tracking protrusion and said overcap has at least one J-slot.

9. The child resistant overcap and container device of claim 8 wherein said at least one J-slot tracking protrusion is located on said collar front.

10. The child resistant overcap and container device of claim 8 wherein said collar has at least two J-slot tracking protrusions and said overcap has at least two J-slots.

11. A child resistant overcap and container device, which comprises:

a.) a container having a round neck for attachment of a cap, and having a hollow body, a portion of said hollow body being an upper body, adjacent said round neck, said upper body having an oval footprint with a front and a back and opposing sides, said upper body having a predetermined width as measured from side to side, and a predetermined depth as measured from front to back, wherein said predetermined width is greater than said predetermined depth;

b.) a collar permanently attached to said round neck, said collar having an open, central circular portion about said round neck, said central circular portion having front and back and opposing sides, said collar having a pair of opposite shoulders extending outwardly from said central circular portion and above said shoulders of said upper body of said container, said collar having one of at least one J-slot and at least one J-slot tracking protrusion located on at least one of its front and back;

c.) a cap removably attachable to said round neck of said container;

d.) an overcap having a front and a back and opposing sides, and having a hollow inside, and having an outside footprint substantially corresponding to said footprint of said upper body of said container, said overcap, relative to said collar, having the other of at least one J-slot and at least one J-slot tracking protrusion located in at least one of said front and said back; wherein a user may create a child resistant closure by pushing said overcap downwardly on said collar with said overcap front in alignment so is to cause movement of at least one J-slot for locking engagement thereof wherein said opposite shoulders of said collar push upwardly against said overcap to maintain J-slot and protrusion engagement, and wherein said overcap is removed by complex motion of pushing downwardly and rotating and then lifting upwardly.

12. The child resistant overcap and container device of claim 11 wherein said neck is a threaded neck and said cap is a screwcap.

13. The child resistant overcap and container device of claim 11 wherein said collar shoulder are springs adapted to push upwardly on said overcap when said overcap is attached to said collar.

14. The child resistant overcap and container device of claim 13 wherein said overcap includes spring contacts on its inside sides corresponding to and adapted to engage said collar springs when said overcap is attached to said collar.

15. The child resistant overcap and container device of claim 11 wherein said collar has at least one J-slot and said overcap has at least one J-slot tracking protrusion.

16. The child resistant overcap and container device of claim 15 wherein said at least one J-slot is located on said collar front.

17. The child resistant overcap and container device of claim 15 wherein said collar has at least two J-slots and said overcap has at least two J-slot tracking protrusions.

18. The child resistant overcap and container device of claim 11 wherein said collar has at least one J-slot tracking protrusion and said overcap has at least one J-slot.

19. The child resistant overcap and container device of claim 18 wherein said at least one J-slot tracking protrusion is located on said collar front.

20. The child resistant overcap and container device of claim 18 wherein said collar has at least one J-slot tracking protrusions and said overcap has at least two J-slots.

* * * * *